US008860626B2

(12) United States Patent
Renilson et al.

(10) Patent No.: US 8,860,626 B2
(45) Date of Patent: Oct. 14, 2014

(54) FOLDED TAB RETENTION TWIN WALL RADOME AND METHOD OF MANUFACTURE

(75) Inventors: Ian Renilson, Dalgetty Bay (GB); Alastair D. Wright, Edinburgh (GB); John S. Curran, Kirkcaldy (GB); David K. Tappin, Dunfermline (GB)

(73) Assignee: Andrew LLC, Hickory, NC (US)

( * ) Notice: Subject to any disclaimer, the term of this patent is extended or adjusted under 35 U.S.C. 154(b) by 200 days.

(21) Appl. No.: 13/248,100

(22) Filed: Sep. 29, 2011

(65) Prior Publication Data

US 2013/0082896 A1 Apr. 4, 2013

(51) Int. Cl.
*H01Q 1/42* (2006.01)
*H01Q 19/12* (2006.01)
*H01Q 15/16* (2006.01)

(52) U.S. Cl.
CPC ..... *H01Q 15/16* (2013.01)
USPC ..... 343/872; 343/840

(58) Field of Classification Search
CPC ..... H01Q 1/005; H01Q 1/02; H01Q 1/42; H01Q 1/422; H01Q 1/424; H01Q 1/425; H01Q 1/427; H01Q 1/428
USPC ..... 343/834, 840, 872, 878, 912, 916; 229/108.1, 109, 117.25
See application file for complete search history.

(56) References Cited

U.S. PATENT DOCUMENTS

| | | | | |
|---|---|---|---|---|
| 2,952,189 | A | 9/1960 | Pajes | |
| 3,246,333 | A * | 4/1966 | Hacking | 343/872 |
| 3,388,401 | A | 6/1968 | Weir | |
| 3,432,859 | A * | 3/1969 | Plant et al. | 343/872 |
| 3,781,898 | A | 12/1973 | Holloway | |
| 4,126,864 | A | 11/1978 | Hopkins | |
| 4,585,143 | A * | 4/1986 | Fremow et al. | 206/386 |
| D304,454 | S | 11/1989 | Serres | |
| 4,918,459 | A * | 4/1990 | De Teso | 343/872 |
| 5,162,806 | A | 11/1992 | Monser | |
| 5,451,972 | A | 9/1995 | Franklin | |
| 5,528,253 | A | 6/1996 | Franklin | |
| 5,940,047 | A | 8/1999 | Pfnister | |
| 6,137,449 | A | 10/2000 | Kildal | |
| 6,437,757 | B1 | 8/2002 | Butler | |
| 7,042,407 | B2 * | 5/2006 | Syed et al. | 343/705 |
| 7,161,553 | B2 | 1/2007 | Courtney | |
| 2005/0035923 | A1 | 2/2005 | Syed et al. | |
| 2005/0190116 | A1 | 9/2005 | Syed et al. | |
| 2007/0200785 | A1 * | 8/2007 | Courtney | 343/872 |
| 2009/0295677 | A1 * | 12/2009 | Gratton et al. | 343/878 |
| 2011/0285604 | A1 | 11/2011 | Le Bayon et al. | |

OTHER PUBLICATIONS

Sung Chul Kang, International Search Report, Jan. 29, 2013, Daejeon Metropolitan City, Korea.

* cited by examiner

*Primary Examiner* — Hoang V Nguyen
*Assistant Examiner* — Patrick Holecek
(74) *Attorney, Agent, or Firm* — Babcock IP, PLLC

(57) ABSTRACT

A radome for covering an open end of a reflector dish of a reflector antenna has a generally planar portion of twin-wall extruded polymer material dimensioned to cover the open end of the reflector dish. A periphery of the planar portion is provided with a plurality of slits, the slits defining a plurality of tabs. The tabs are dimensioned for folding around a rim of the reflector dish. The tabs may be retained in the folded position by, for example, a band clamp or directly coupling a portion of the tabs to the planar portion.

20 Claims, 10 Drawing Sheets

FOLDED TAB RETENTION TWIN WALL RADOME AND METHOD OF MANUFACTURE

BACKGROUND

1. Field of the Invention

This invention relates to microwave reflector antennas. More particularly, the invention relates to a radome for a reflector antenna utilizing a cost effective twin-wall extruded polymer material retained via folding the material around a rim of the reflector dish.

2. Description of Related Art

The open end of a reflector antenna is typically enclosed by a radome coupled to the distal end (the open end) of the reflector dish. The radome provides environmental protection and improves wind load characteristics of the antenna. Because reflector antennas are often mounted in remote locations, such as high atop radio towers, a radome failure may incur significant repair/replacement expense.

Prior radomes have utilized, for example, woven fabric stretched across the distal end of the reflector dish and held in place by a plurality of springs and/or hooks. Woven fabrics may be subject to degradation and/or stretching over time. Alternatively, specialized woven fabrics with sufficient strength to endure long term environmental exposure may be expensive. Also, the numerous connections required to evenly tension the fabric across the distal end of the reflector dish may complicate radome installation and/or removal.

Another common radome configuration is a rigid and/or semi-rigid injection molded and/or machined solid polymer portion dimensioned to seat upon the open end of the reflector dish. Such radomes may be retained, for example, by a band clamp or the like that couples the radome to the rim of the reflector dish. Injection molding and/or machining may require significant capital investment in specialized equipment and operations/maintenance personnel.

Competition in the reflector antenna market has focused attention on improving electrical performance and minimization of overall manufacturing, inventory, distribution, installation and maintenance costs. Therefore, it is an object of the invention to provide a radome and resulting reflector antenna assembly that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have recognized that a radome utilizing commonly available twin-wall extruded polymer sheet material may enable significant materials, manufacturing and/or installation efficiencies.

Figure 1:
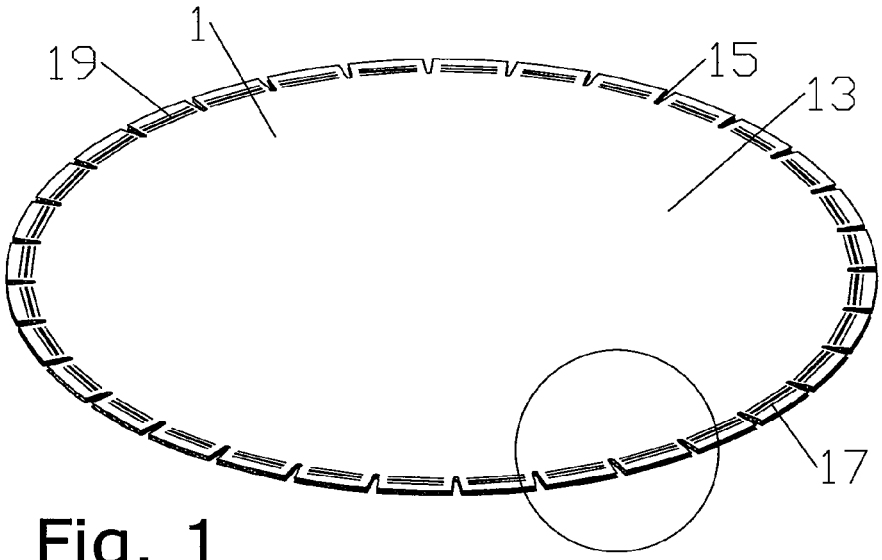
FIG. 1 is a schematic isometric front view of an exemplary planar portion of twin wall extruded polymer material.
Figure 2:
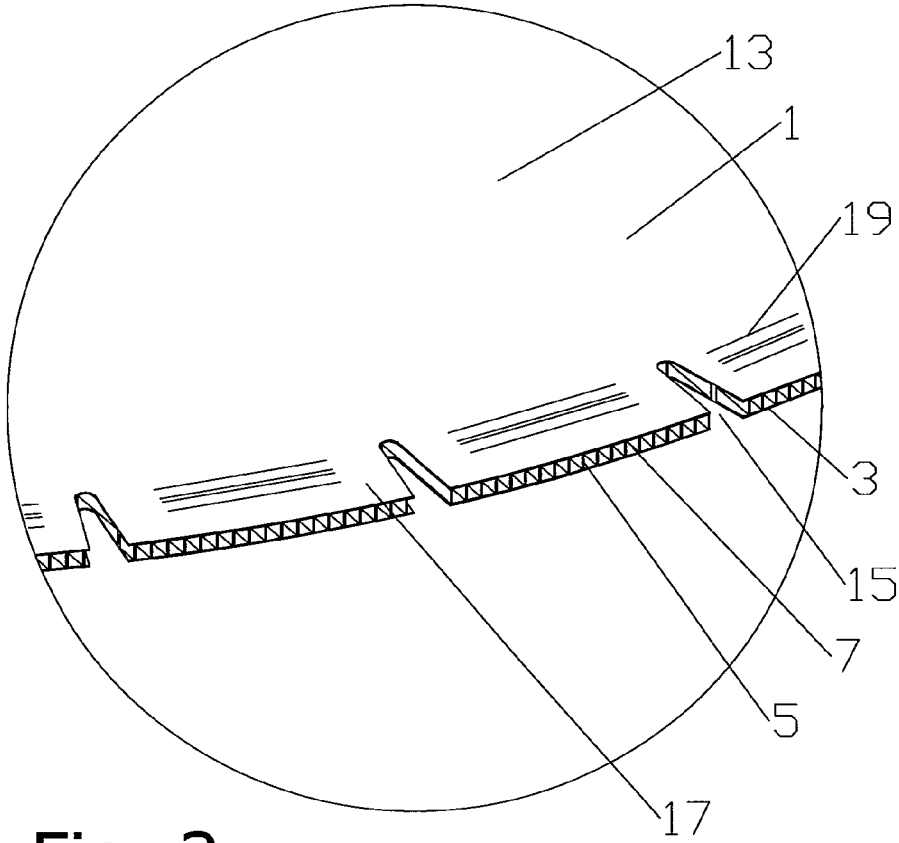
FIG. 2 is a close-up view of the planar portion of FIG. 1.

As best shown in FIGS. 1 and 2, twin-wall extruded polymer material has a front wall 1 and a back wall 3, the front wall 1 and the back wall 3 separated by a plurality of flutes 5, with a hollow channel 7 provided between each of the flutes 5. Typical of extruded material, the channels 5 may be generally linear, with each of the channels 5 aligned parallel to one another. One skilled in the art will appreciate that the self reinforcing twin-wall configuration provides a low weight and cost efficient planar structure with significantly improved strength characteristics compared to common single-wall polymer sheets. Such material is available in bulk quantities, commonly utilized for example, as an inexpensive support surface for temporary signage and the like. The material is available with a range of different dimensions (flute height, wall thickness and/or channel spacing) and polymer materials, for example with varying degrees of additives and/or surface treatments providing desired strength, dielectric properties, ultra-violet and/or flame resistance characteristics. A spacing between the twin-walls and/or thickness of the front wall 1 and back wall 3 may be selected, for example, based upon the diameter of the rim 9 of the reflector dish 11 and desired strength characteristic of the resulting radome therefore. A suitable twin-wall extruded polymer material is "Correx" brand twin-wall polypropylene sheet material, available from DS Smith Correx of Gloucester, United Kingdom. To further improve ultra-violet resistance characteristics of the selected twin-wall extruded polymer material, the front face 1 may be coated by, for example, printing and/or lacquer (varnish) with an ultra-violet resistant material.

Figure 3:
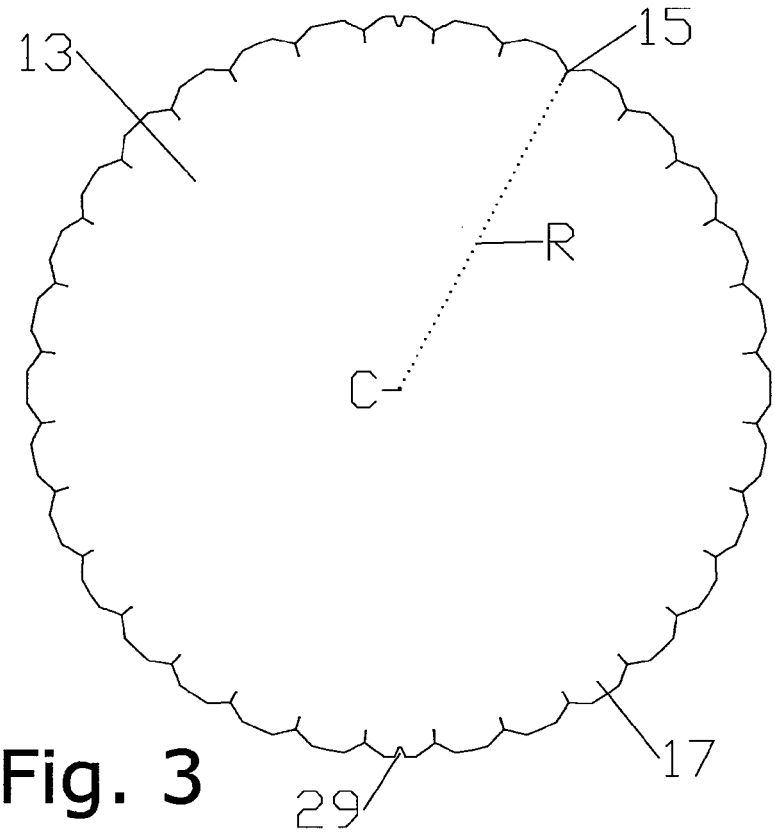
FIG. 3 is a schematic front view of an alternative planar portion of twin wall extruded polymer material.

The twin-wall extruded polymer material is provided in a generally planar portion 13 dimensioned to cover the open end of the desired reflector dish 11. A periphery of the planar portion 13 is provided with a plurality of slits 15, the slits 15 defining a plurality of tabs 17. As best shown in FIG. 3, the slits 15 may be applied radially, for example along construction line R, with respect to a center "C" of the planar portion 13.

Figure 4:
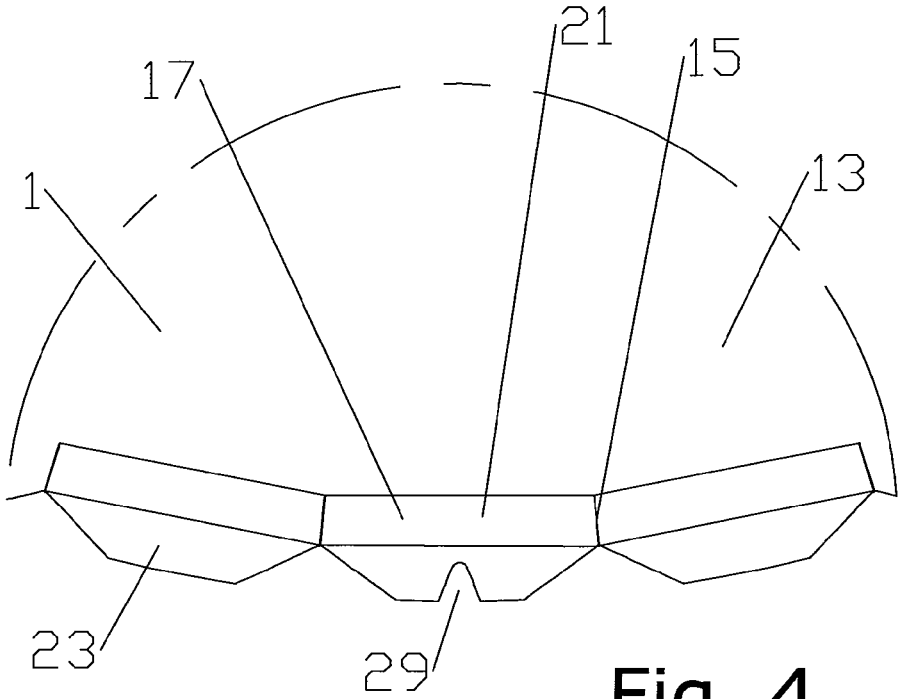
FIG. 4 is a close-up view of the planar portion of FIG. 3.
Figure 5:
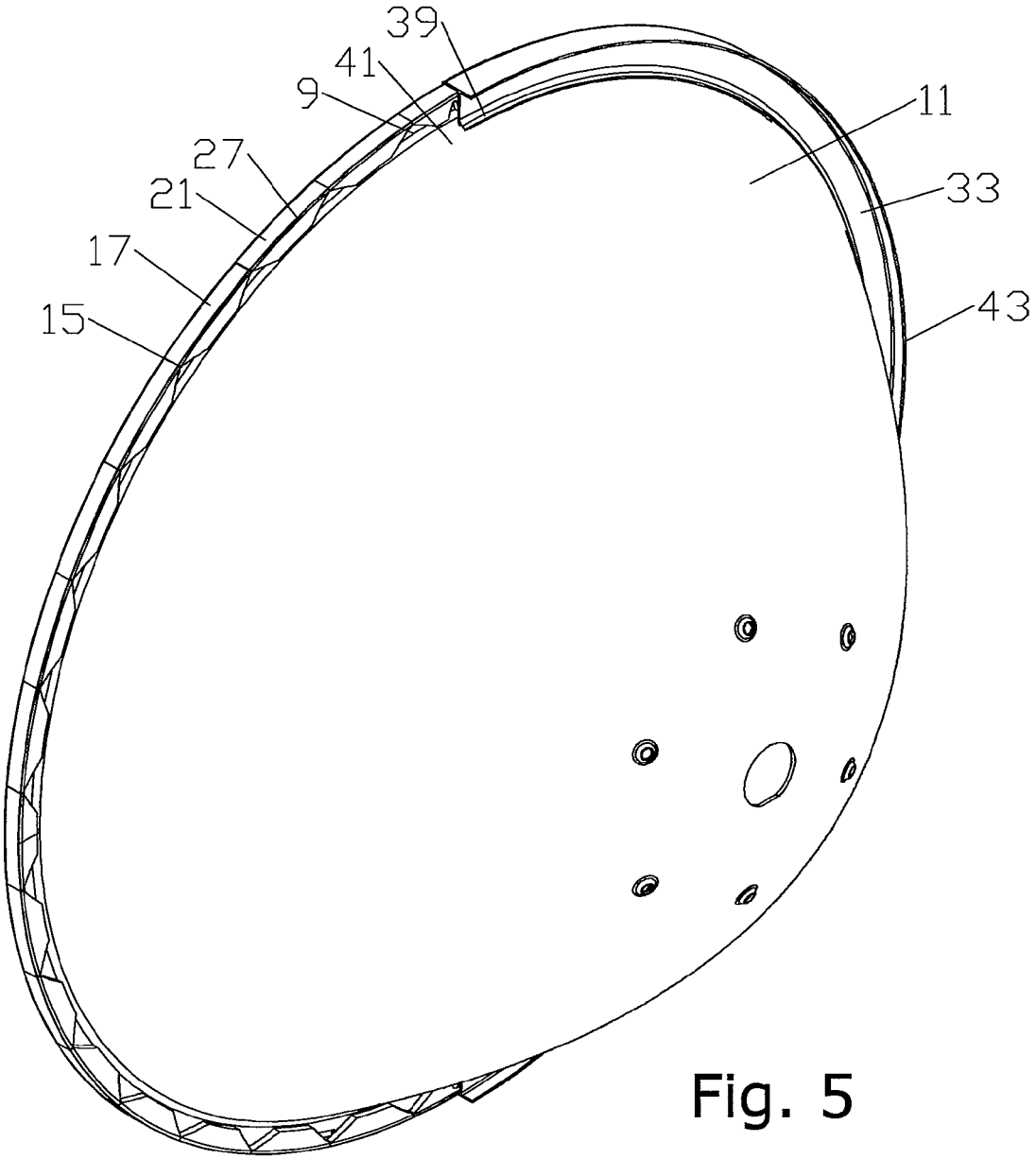
FIG. 5 is a schematic isometric back view of a reflector dish with a radome of the planar portion configuration of FIG. 3 and one portion of a band clamp attached.
Figure 6:
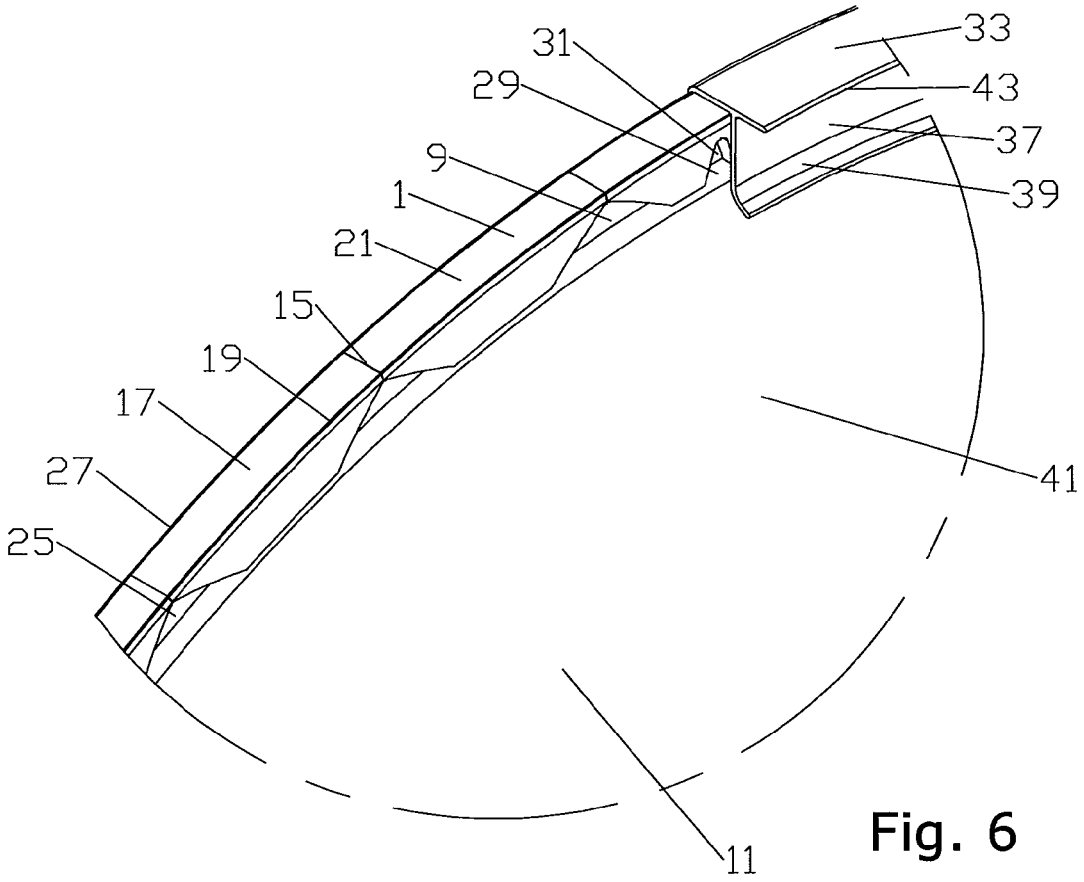
FIG. 6 is a close-up view of the reflector dish of FIG. 5.
Figure 7:
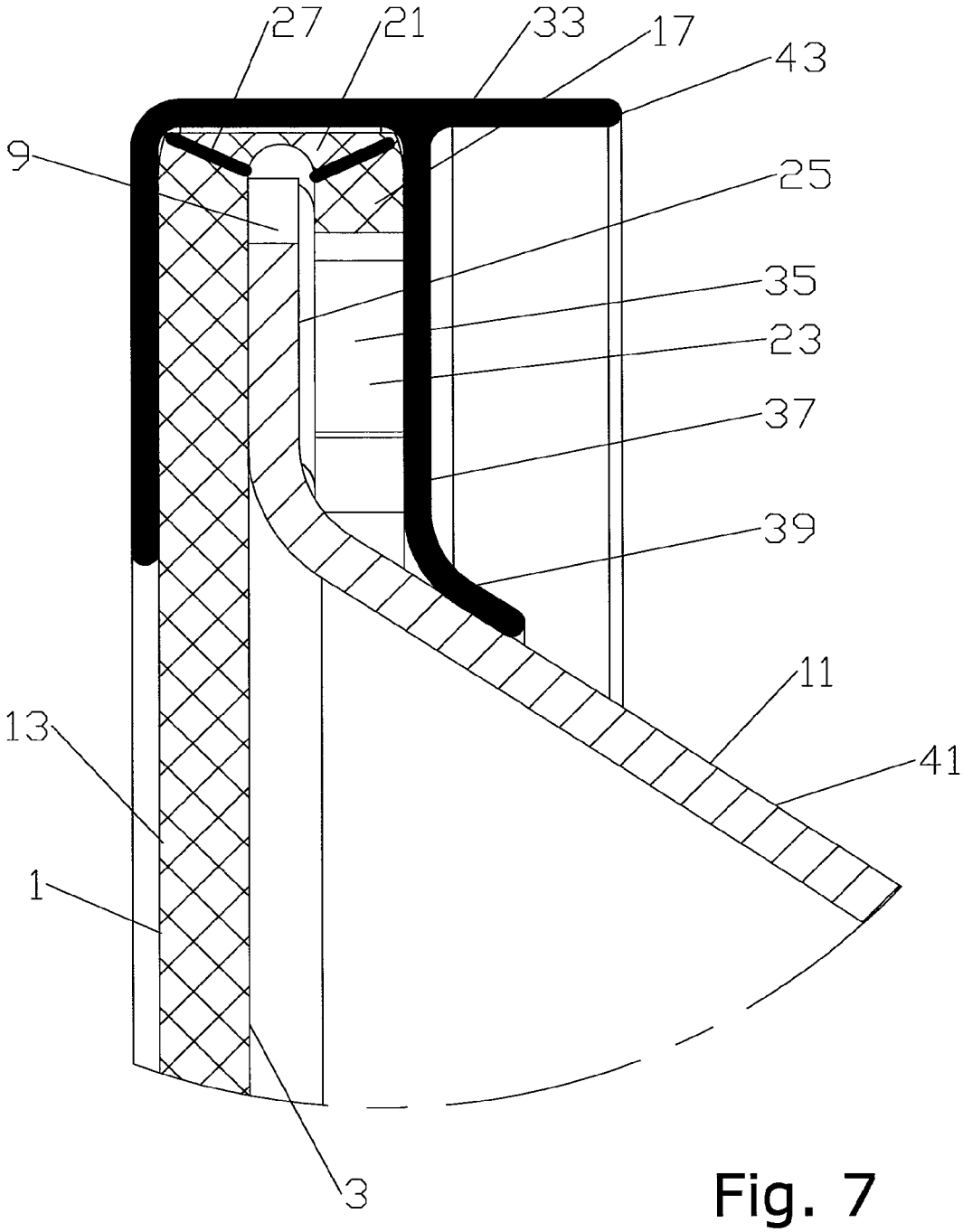
FIG. 7 is a cross section view of the reflector dish of FIG. 6.
Figure 8:
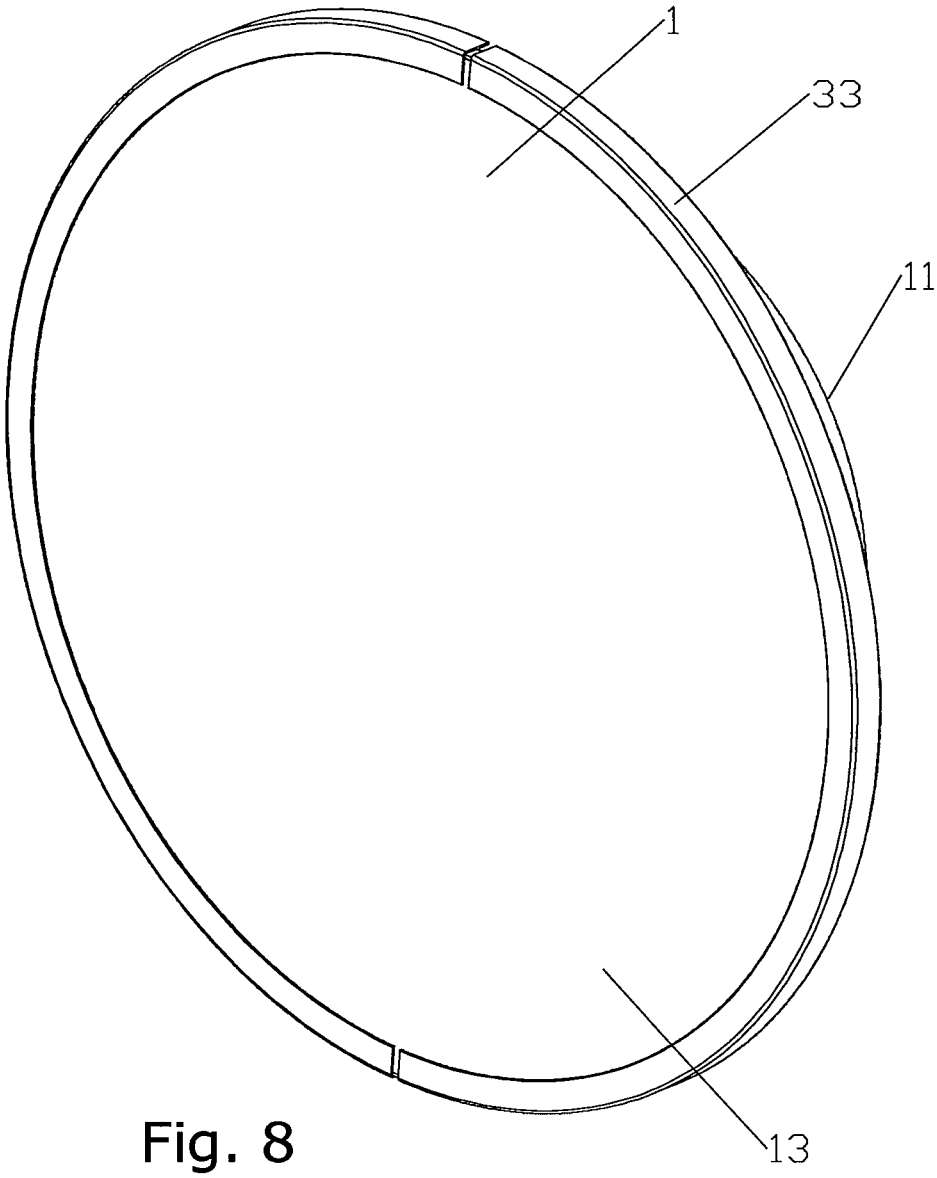
FIG. 8 is a schematic isometric front view of the reflector dish of FIG. 5, with the band clamp fully attached.

As best shown in FIGS. 4-6, the tabs 17 are dimensioned for folding around the rim 9 of the reflector dish 11. Fold guides 19, such as creases, scoring and/or groups of partial perforations or the like may be applied to pre-designate precise desired fold locations of the tabs 17. For example, the fold guides 19 may define a first portion 21 and a second portion 23 of each tab 17; the first portion 21 is dimensioned to seat against an outer diameter of the rim 9 and the second portion 23 is dimensioned to seat against a back side 25 of the rim 9.

One skilled in the art will appreciate that folding tabs 17 around the outer diameter of the rim 9 and then radially inward will introduce edge-to-edge interference as second portions 23 with a larger circumference are translated inward to an area with a smaller circumference. Such interference may be avoided, for example, by applying slits 15 with a V shape (see FIG. 2), and/or tapering at least the second portions 23 (see FIG. 4). Because the twin-wall extruded polymer material is relatively thin, the desired slits 15 and other desired features may be cost effectively precision formed by, for example, stamping and/or laser cutting. Where formed with suitable precision, the interference between folded tabs 17 may operate as a seal for channels 7 open to the slits 15.

When each of the tabs 17 is folded around the rim 9 of the reflector dish 11, the hollow channels 7 of the twin-wall material collapse at an edge 27, such as the fold guide 19, if present, securely coupling the planar portion 13 to the rim 9 until such folds are straightened. One skilled in the art will appreciate that the hollow channel 7 collapses along the circumference of the rim 9, thereby providing a longitudinal interlock across the rim diameter that secures the planar portion 13 in position without requiring further clamping, perforation and/or compression as long as the folds are maintained seated against the rim 9. Because the hollow channel 7 is collapsed along the edge 27, tension applied upon the radome surface is unable to pull the planar portion 13 from its position at the rim 9, as such would require destruction of the hollow channel structure at either side of the edge 27 before further displacement can occur.

Although the hollow channels 7 are sealed between the front wall 1, back wall 3 and flutes 5, the ends of the channels 7 may present an entry path for moisture to accumulate within the channels 7. The collapse of the channels 7 at the edge 27 as the tabs 17 are folded provides a significant seal against moisture entry. To allow any moisture which does enter and/or condense within the channels 7 to drain rather than accumulate along the channels 7, the planar portion 13 may be aligned on the rim 9 such that the channels 7 are normal to a plane of the ground. Thereby, any moisture accumulation that occurs within the channels 7 will drain by gravity toward the bottom of the rim 9, out of the reflector antenna signal path. Alternatively, the channels 7 may be aligned, for example, at 45 degrees so that any RF influence generated by the channel sidewalls impacts neither of the critical horizontal or vertical planes.

As best shown in FIG. 4, at least one alignment feature 29, such as a cutout, notch or the like may be applied as an assembly alignment guide, for example located proximate a top and/or bottom of the rim 9. The alignment feature 29 may key with an alignment structure 31 such as a protrusion located on the back side 25 of the rim 9 to orient the planar portion 13 with the channels 7, for example, either normal to the anticipated ground plane when the reflector antenna is installed or at 45 degrees.

The folded tabs 17 may be retained in contact with the rim outer diameter and back side 25 by applying a band clamp 33, for example as shown in FIGS. 5-8. The band clamp 33 may be dimensioned with an inner diameter slot 35 dimensioned to fit over the combined thickness of the planar portion 13, the rim 9 and the second portion 23. As the dielectric characteristic of the twin-wall polymer material creates a signal path between the rim 9 and the band clamp 33, the band clamp 33 may be dimensioned with a proximal lip 37 provided with a turnback region 39 dimensioned to engage an outer surface 41 of a signal area of the reflector dish 11 in an interference fit as the band clamp 33 is tightened upon the planar portion 13 and tabs 17 folded around the rim 9. Thereby, any signal leakage which might otherwise result in undesirable backlobe signal patterns may be reduced.

The turnback region 39 may be applied, for example, as an outward bend prior to the inward end of the proximal lip 37. As the band clamp 33 is tightened during interconnection of the radome and the reflector dish 11, the diameter of the band clamp 33 is progressively reduced, driving the turnback region 39 against the convex outer surface 41 of the signal area of the reflector dish 9, into a uniform circumferential interference fit. As the band clamp 33 is further tightened, the turnback region 39 slides progressively inward along the outer surface 41 of the signal area of the reflector dish 11 toward the reflector dish proximal end. Thereby, the distal lip of the band clamp also moves towards a proximal end of the reflector dish 11, securely clamping the planar portion 13 against the rim 9. Because the interference fit between the turnback region 39 and the outer surface 41 of the reflector dish 11 is circumferentially uniform, any RF leakage between these surfaces may be reduced.

The bandclamp 33 may be further provided with a depth flange 43 extending toward the reflector dish proximal end a distance selected for example with respect to a desired operating frequency of the resulting reflector antenna, for example between 0.8 and 1.5 wavelengths of the operating frequency, further reducing backlobe components of the resulting reflector antenna signal pattern that may be otherwise generated by the presence of the bandclamp 33, for example by generating mutual interference of surface currents traveling along the outer periphery of the band clamp 33.

Alternatively, as demonstrated in FIGS. 9-13, the tabs 17 and/or rim 9 may be dimensioned to enable retention of the planar portion 13 upon the rim 9 via direct coupling between the planar portion 13 and the second portion 23. As the width of each tab 17 is increased, the periphery of the planar portion 13 progressively transitions from generally circular to multi-faceted. With wider tabs 17, the portions proximate each side of the tabs 17 begin to stand away from the close fit with the periphery of the rim 9 occurring at the midpoint of each tab 17, and/or the rim 9 may also be modified from circular configuration to match the multi-faceted dimensions generated by wider tabs 17.

Figure 9:
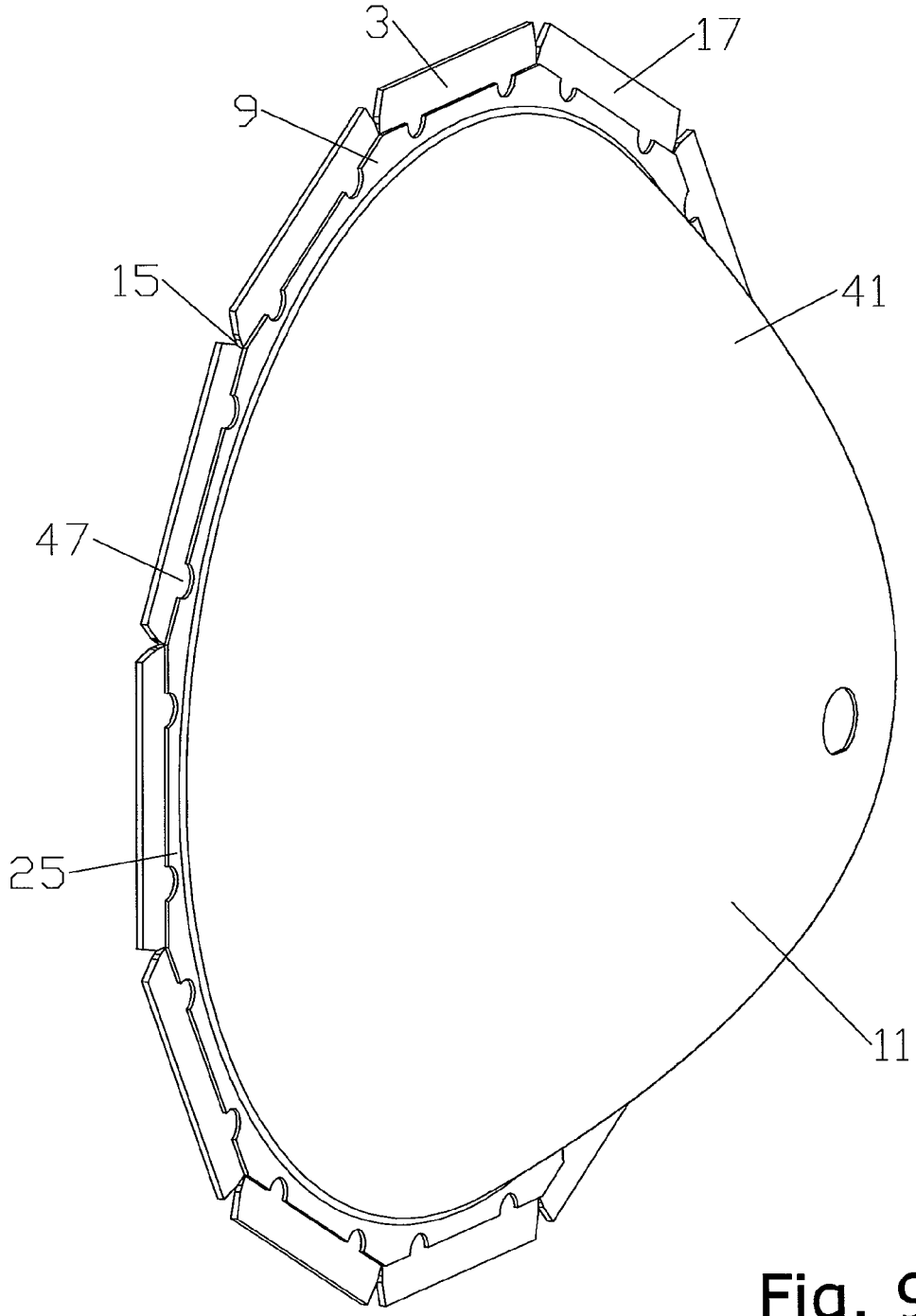
FIG. 9 is a schematic isometric back view of a planar portion positioned on the rim of a reflector dish, prior to folding the tabs.
Figure 10:
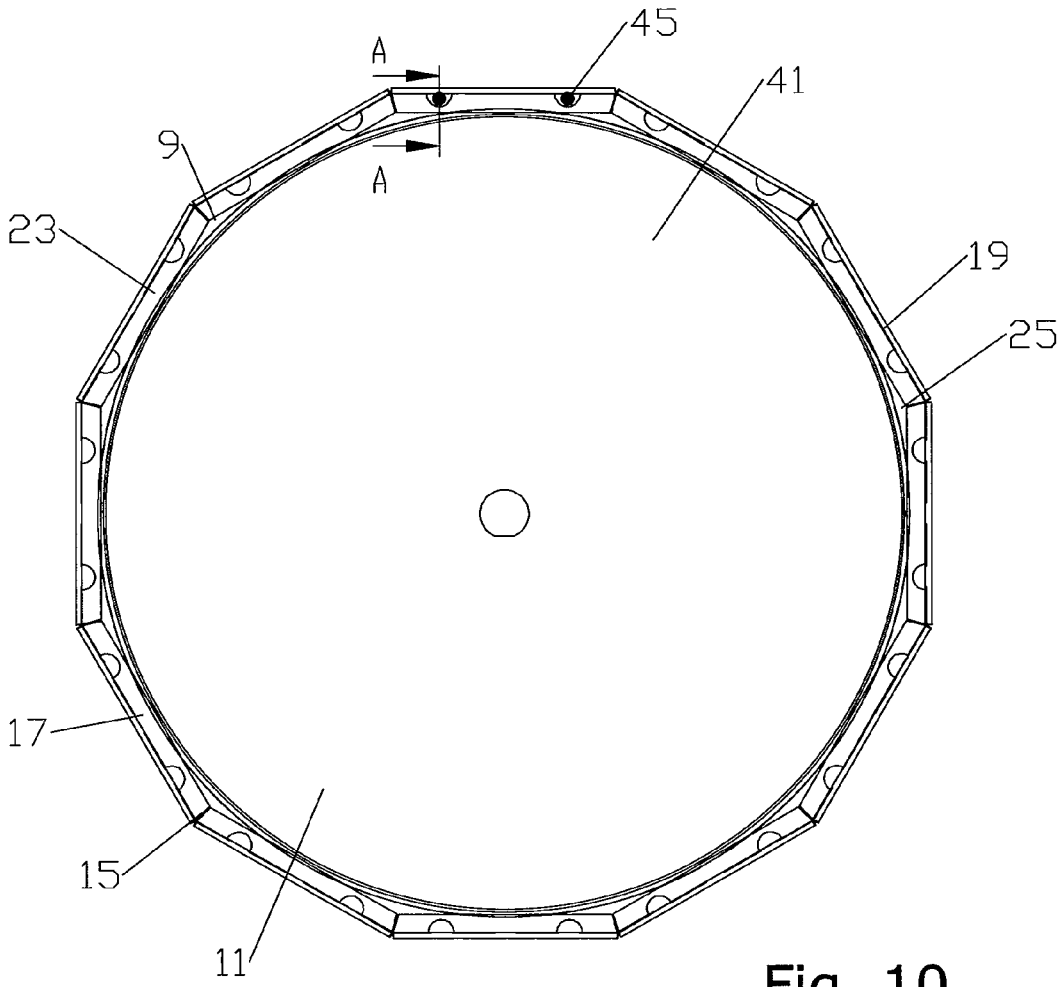
FIG. 10 is a back view of the planar portion of FIG. 9, with the tabs folded around the rim.
Figure 11:
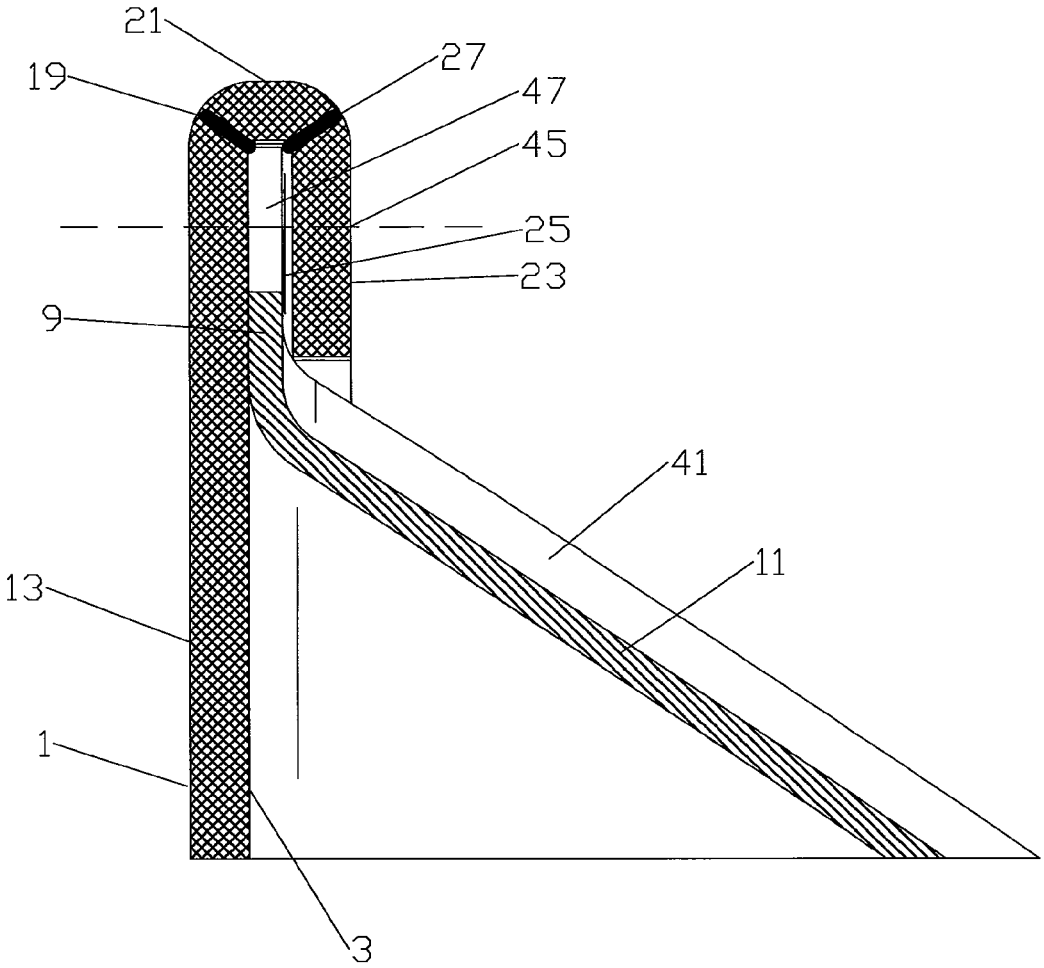
FIG. 11 is a close-up cross section view of the planar portion of FIG. 10.
Figure 12:
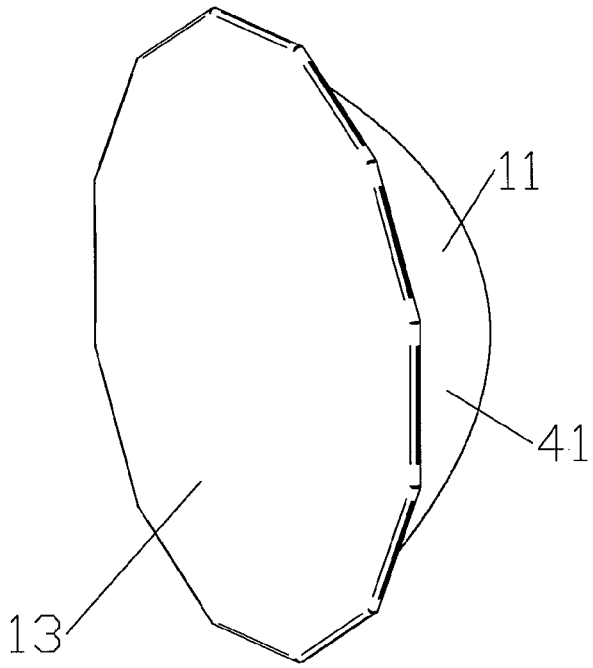
FIG. 12 is a schematic isometric front view of the radome and reflector dish of FIG. 10.
Figure 13:
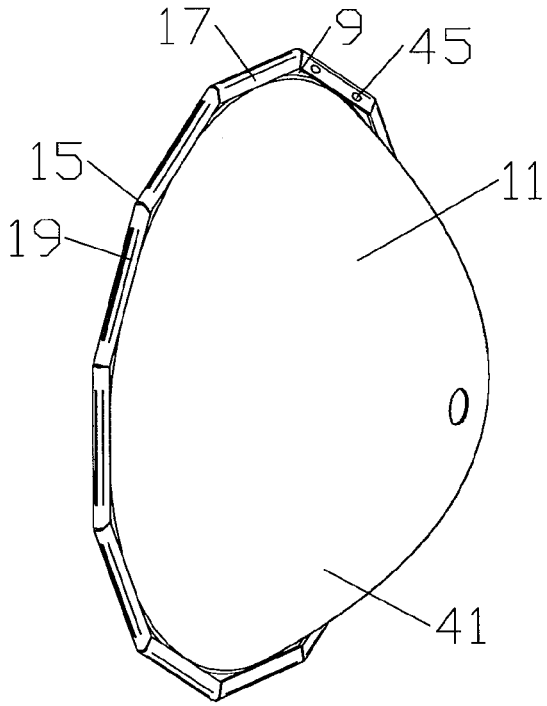
FIG. 13 is a schematic isometric view of the radome and reflector dish of FIG. 10.

As best shown in FIG. 9, where the rim 9 is provided with a corresponding multi-faceted profile corresponding to widened tabs 17, attachment areas 45 between the planar portion 13 and the second portion 23 may be provided via attachment area cut-outs 47 of the rim 9. As shown in FIGS. 10 and 11, coupling between the planar portion 13 and the second portion 23 at the attachment areas 45 may be performed, for example, via ultrasonic welding, heat staking, mechanical fasteners or the like. Further, heat staking which fuses the front and back walls 1, 3 to each other, for example proximate the periphery of the rim 9 prior to the slits 15, may also be applied as an additional environmental seal of the channels 7.

Because the twin-wall extruded radome material enables simplified radome and reflector dish periphery geometries, the resulting reflector antenna may have improved materials and manufacturing costs. Because the radome is simply and securely attached, installation and maintenance may be simplified compared to prior reflector antenna configurations with cost intensive molded/machined radome elements, complex peripheral geometries, delicate back lobe suppression ring coatings, platings and/or RF absorbing materials. Where the band clamp 33 is omitted entirely, one skilled in the art will appreciate that in addition to improving the electrical performance of the reflector antenna by eliminating the signal conducting structure of a radome retaining band clamp 33, the reduction in components in addition to simplification of the radome material may further reduce the overall cost of the resulting reflector antenna,

| Table of Parts | |
|---|---|
| 1 | front wall |
| 3 | back wall |
| 5 | flute |
| 7 | channel |
| 9 | rim |
| 11 | reflector dish |
| 13 | planar portion |
| 15 | slit |
| 17 | tab |
| 19 | fold guide |
| 21 | first portion |
| 23 | second portion |
| 25 | back side |
| 27 | edge |
| 29 | alignment feature |
| 31 | alignment structure |
| 33 | band clamp |
| 35 | slot |
| 37 | proximal lip |
| 39 | turnback region |
| 41 | outer surface |
| 43 | depth flange |
| 45 | attachment area |
| 47 | attachment cut-out |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A radome for covering an open end of a reflector dish of a reflector antenna, comprising:

a generally planar portion of twin-wall extruded dielectric polymer material dimensioned to cover the open end of the reflector dish;

a periphery of the planar portion provided with a plurality of slits, the slits defining a plurality of tabs;

the tabs dimensioned for folding around a radial outward projecting rim of the reflector dish.

2. The radome of claim 1, wherein the slits are aligned radially from a center of the planar portion.

3. The radome of claim 1, wherein the twin-wall extruded polymer material has a front wall and a back wall, the front wall and the back wall separated by a plurality of flutes; a hollow channel provided between each of the flutes.

4. The radome of claim 2, wherein the channels are generally linear; each of the channels aligned parallel to one another.

5. The radome of claim 1, further including a band clamp dimensioned to retain the planar portion upon the reflector dish, the tabs folded around the rim.

6. The radome of claim 5, wherein the band clamp is a band with an inward projecting proximal lip and an inward projecting distal lip;

the proximal lip provided with a turnback region dimensioned to engage an outer surface of a signal area of the reflector dish in an interference fit.

7. The radome of claim 1, wherein the tabs are provided with attachment areas between the planar portion and a second portion of each tab, when the tab is folded around the rim of the reflector dish.

8. The radome of claim 7, wherein the attachment areas are dimensioned for alignment with attachment area cut-outs of the rim.

9. The radome of claim 1, further including fold guides provided on the tabs; the fold guides defining a first and a second portion of each tab; the first portion dimensioned to seat against an outer diameter of the rim and the second portion dimensioned to seat against a back side of the rim.

10. The radome of claim 1, further including at least one alignment feature formed proximate the periphery of the planar portion; the at least one alignment feature dimensioned to key with an alignment structure of the rim, whereby the planar portion is aligned at a desired angle.

11. The radome of claim 1, wherein a plurality of hollow channels of the planar portion are aligned at 45 degrees from a plane of the ground, when the planar portion is coupled to the rim.

12. A method for attaching a radome to an open end of a reflector dish of a reflector antenna, comprising the steps of:

providing a generally planar portion of twin-wall extruded dielectric polymer material dimensioned to cover the open end of the reflector dish;

providing a a plurality of slits in the periphery of the planar portion, the slits defining a plurality of tabs; and folding the tabs around a radial projecting rim of the reflector dish.

13. The method of claim 12, further including the step of forming fold guides on the tabs; the fold guides defining a first and a second portion of each tab; the first portion dimensioned to seat against a periphery of the rim and the second portion dimensioned to seat against a back side of the rim.

14. The method of claim 12, further including the step of providing a band clamp dimensioned to retain the planar portion upon the reflector dish, the tabs folded around the rim.

15. The method of claim 14, wherein band clamp is provided with an inward projecting proximal lip and an inward projecting distal lip;

the proximal lip provided with a turnback region dimensioned to engage an outer surface of a signal area of the reflector dish in an interference fit as the band clamp is tightened upon the planar portion and tabs folded around the rim.

16. The method of claim 12, further including the step of providing at least one alignment cutout proximate the periphery of the planar portion; the at least one alignment cutout dimensioned to engage an alignment feature of the rim, whereby the planar portion is aligned such that a plurality of hollow channels of the planar portion are aligned normal to a plane of the ground, when the planar portion is coupled to the rim.

17. The method of claim 12, wherein the twin-wall extruded plastic material has a front wall and a back wall, the front wall and the back wall separated by a plurality of flutes; a hollow channel provided between each of the flutes.

18. The method of claim 12, wherein the folding of the tabs collapses the hollow channels at an edge between the planar portion and a first portion dimensioned to seat against a periphery of the rim and between the first portion and a second portion dimensioned to seat against a back side of the rim.

19. The method of claim 12, wherein the tabs are folded defining a first and a second portion of each tab; the first portion dimensioned to seat against a periphery of the rim and the second portion dimensioned to seat against a back side of the rim.

20. The method of claim 19, wherein the planar portion is coupled to the second portion at an attachment area, the planar portion and the second portion abutting one another at the attachment area.

* * * * *